United States Patent [19]

Aquilla

[11] 4,109,842

[45] Aug. 29, 1978

[54] SHEET STRIPPING DEVICE

[76] Inventor: John J. Aquilla, c/o Converted Paper Prod., 1529 Dean St., Brooklyn, N.Y. 11213

[21] Appl. No.: 549,517

[22] Filed: Feb. 13, 1975

[51] Int. Cl.[2] ..... B65H 35/10; B26F 3/02

[52] U.S. Cl. ..... 225/98; 93/36 A

[58] Field of Search ..... 225/97, 98, 99; 83/102, 83/105, 106, 923; 93/36 A, 59 ES; 271/64, 174, DIG. 2

[56] References Cited

U.S. PATENT DOCUMENTS

| | | | |
|---|---|---|---|
| 2,508,083 | 5/1950 | Winkler | 225/99 X |
| 2,655,842 | 10/1953 | Baumgartner | 93/36 A |
| 3,266,388 | 8/1966 | Jones | 225/97 |
| 3,269,624 | 8/1966 | Vonhof et al. | 225/97 |

*Primary Examiner*—Othell M. Simpson

[57] ABSTRACT

In a preferred embodiment, conveyor belts spaced apart and extending and moving in a common direction have an upwardly extending angularly inclined projection extending in a direction opposite to the direction of movement of the conveyor belts, located between or closely adjacent to the conveyor belt(s), with pincher opposing rollers positioned for engaging sheet carried on an upper surface of the belts for thereby anchoring the sheet adjacent the inclined projection, the leading surface of the inclined projection being shaped to guide stripped sheet material downwardly between pincher rollers forcing the strip downwardly from its stripped point, such that a sheet precut with a minor strip thereof being only intermittently connected to a major section of greater surface area, is easily stripped from the major section as the major stripped section is thereby conveyable onwardly to a collection point.

4 Claims, 5 Drawing Figures

SHEET STRIPPING DEVICE

This invention relates to a machine for automatically stripping waste strip material from sheeting such as precut cardboard.

BACKGROUND TO THE INVENTION

Prior to the present invention, it has been customary to precut cardboard sheeting of large size into predetermined typically identical dual pieces connected only intermittently by remaining uncut material along a scored line of cut, and to thereafter have a worker manually strip-away the waste strip material from typically between the dual pieces and from the outer edges also. Such a procedure is extremely time consuming as well as expensive in the thus necessary employment of sufficient laborers to keep up with production by the precutting machine.

SUMMARY OF THE INVENTION

Accordingly, objects of the present invention include the avoiding and/or overcoming of one or more difficulties and problems of the type noted above, together with other novel advantages.

More particularly, another object is to obtain a machine for the automatic systematic stripping of precut and scored waste stripping from sheeting material.

Another object is to prevent tearing or other marring of sheeting during the automatic stripping of waste stripping therefrom.

Another object is to obtain a machine of simple construction and operation such that high cost of production of such machine, installation thereof and operation thereof is avoided, together with the advantages of enhanced production and uniform quality of production.

Other objects become apparent from the preceding and following disclosure.

One or more objects of the present invention are obtained by the invention defined herein.

Broadly the invention may be defined as a stripping machine including motorized conveyor belts preferably, with the belts moving in a direction along their lengths for conveying typically cardboard sheeting thereon in a precut, scored state such that one or more waste strips are moveable in that direction parallel to the length of the waste strips, and a projection element or structure is stationarily positioned in the path of the waste strip each respectively such that pressure of the strip against the projection structure rips or strips away the waste strip as the conveyor belts carry the stripped major or main section onward to a collection point in a conventional manner, the projection element or structure being inclined angularly along its front edge and shaped preferably for directing the stripped strip in a predetermined direction. In further preferred embodiments, there is provided opposing pincher surfaces such as opposing upper and lower rollers positioned for receiving therebetween cardboard sheet material conveyed on the belts, with one of the rollers preferably being driven rotatably to pull-along the sheet material while concurrently anchoring the sheet material substantially adjacent to a point of stripping by a stripper structure. Also, there is preferably a second pincher roller in alignment with the shaped forward or leading face of the stripper structure (projection structure) such that already stripped waste strip is directed between the second pincher roller and the lower one of the preceding upper and lower rollers, resulting in a pulling downwardly of the stripped waste strip; this second pincher roller also preferably being driven at a coordinated speed with the driven lower roller in opposition thereto.

The invention may be better understood by making reference to the following Figures.

THE FIGURES

FIG. 1 illustrates a top, side perspective view of a preferred embodiment of the present invention, shown in an in-part view thereof.

FIG. 2 as taken along line 2—2 of FIG. 1, is a view in cross-section through illustrated cardboard sheeting being processed by the machine, in an in-part view along the width of the machine.

DETAILED DESCRIPTION OF THE INVENTION

Figure 1:
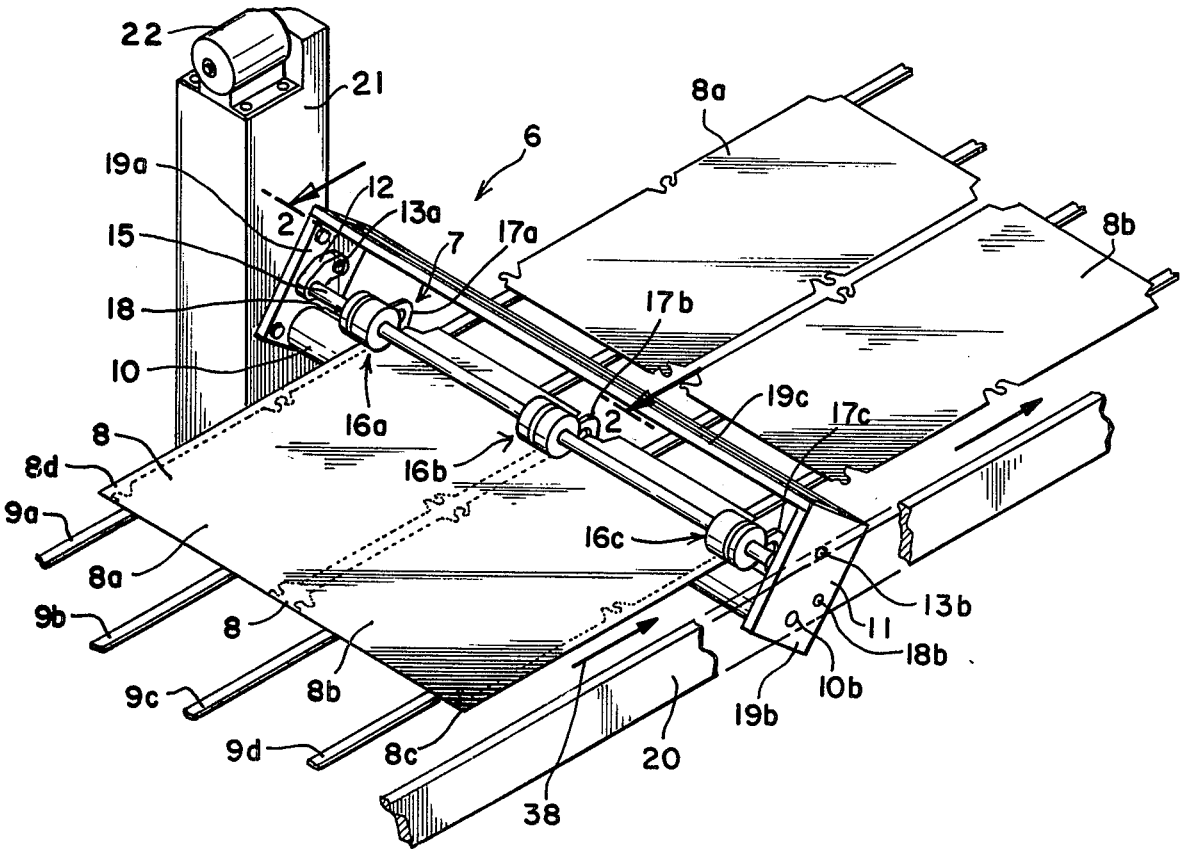
Figure 2:
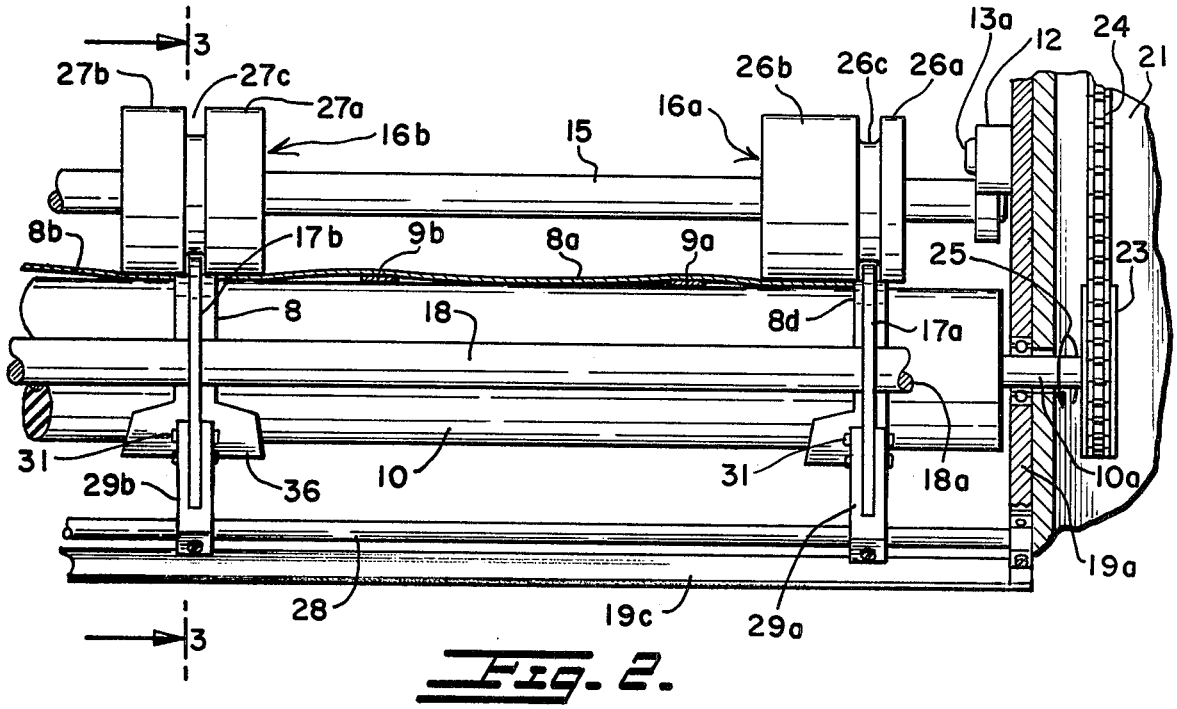
Figure 3:
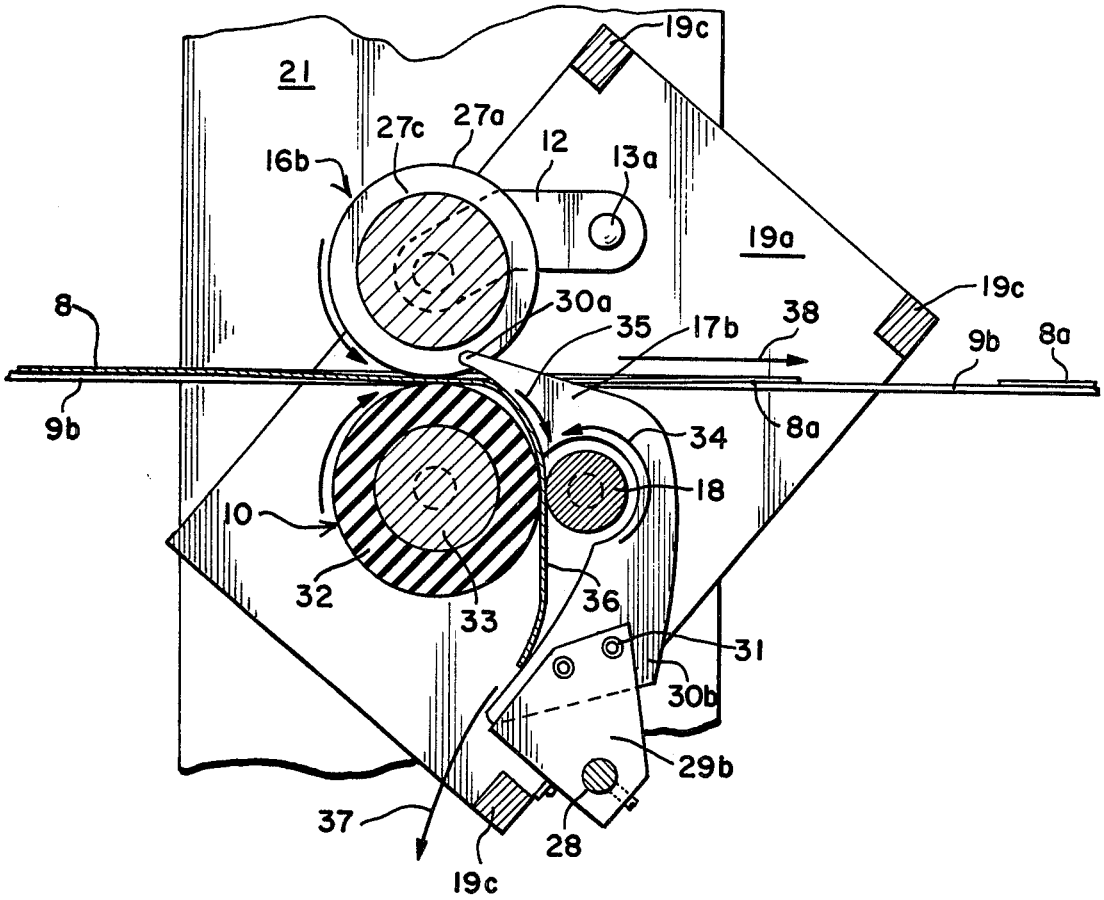
FIG. 3 illustrates a side cross-sectional view as taken along line 3—3 of the FIG. 2 view illustration, through the upper and lower pincher rollers, and a side view of the projection structure, showing the preferred curvature thereof along the leading edge thereof projecting at an inclined angle through the plane of travel of the carboard sheeting carried on the upper surface of the belts.

In greater detail, FIG. 1 illustrates a stripping device 6 including a stripper combination 7 of elements such as projection structures **17*a*, 17*b*, and 17*c* and the pincher roller 18, and including pincher upper rollers 16*a*, 16*b*, and 16*c* and lower pincher roller 10, for the stripping of strips 8*c*, 8*d*, and 8*e* (minor sections) from the major sections 8*a* and 8*b* of the sheeting 8 as it is conveyed on upper surfaces of the parallel belts 9*a*, 9*b*, 9*c*, and 9*d* in direction 38. Support frame 19*b* is mounted on support structure 20 typically, and is connected for stability and strength by cross member 19*c* to opposite end support structure 20 typically. Mounted on or through the respective support structures 19*c* and 19*a* are pincher rollers 10 and 18, and the revolvable shaft 15 carrying the pincher rollers 16*a*, 16*b* and 16*c* each of which include a core mounting section 33 and an exterior resilient or padding composition such as rubber 32 as illustrated in FIG. 3. The shaft 15 is indirectly mounted by the support arms at each of opposite ends, such as support arm 12, mounted on pin 13*a* at one end and on pin 13*b* at an opposite end, as viewable in FIGS. 1 through 3 respectively. The support structure 21 mounts typically the support frame 19*a* and the symbolically disclosed motor drive 22. As best illustrated in FIGS. 2 and 3, the relative positioning of the pincher rollers 16*b*, for example, and 10 and 18, respectively, and the projection structure 17*b*, for example, which projection structure 17*b* includes an upper portion 30*a* extending above a plane of travel of belt 9b, for example, carrying sheeting section 8a, for example, and the projection structure 17b having the curved leading edge extending in an inclined angle of preferably about 45°, but at least lesser than a vertical 90°, and the forward and leading edge 36 being shaped in the illustrated curved shape for effective directing of stripped waste strips 36 downwardly between pincher surfaces of pincher rollers 10 and 18 such that the waste strip 36 is directed in direction 37 and is propelled by these driven pincher rolls. Accordingly, there is illustrated in FIG. 2 a symbollic or diagrammatic driving mechanism driving the mounting pin 10a (corresponding to the pin 10b at an opposite end as viewable in FIG. 1), and by a comparable mechanism, if desired (not illustrated) driving also the pincher roller 18 in direction 34 as by conventional gearing. However, pincher roller 18 may be free-wheeling, with pincher roller 10** being a sole driven pincher roller.

As is best seen in FIGS. 1 and 3 respectively, the shaft 15 mounted on the arms 12 are pivoted by pins 13a and 13b for free swinging of the arms 12, the weight of the shaft 15 and the pincher rollers 16a, 16b, and 16c serving to by-gravity hold downwardly the sheeting 8 against the driven roller 10.

FIG. 3 illustrates further mounting support frame 19c and the mounted mounting base 29b secured by a screw pin onto a support bar 28 appropriately mounted, the mounting base 29b carrying the projection structure 17b by fasteners 31.

The preferred illustrated pincher rolls 16a, 16b, and 16c as best seen in FIGS. 2 and 3 include for example presser sections 27a and 27b spaced apart by slot 27c, and presser sections 26b and 26a separated by groove 26c, with the distal upper end 30a of projection structure 17b for example fitting non-engagingly into the slot 27c, the base or proximal end 30b being mounted by the base 29b.

Figure 4:
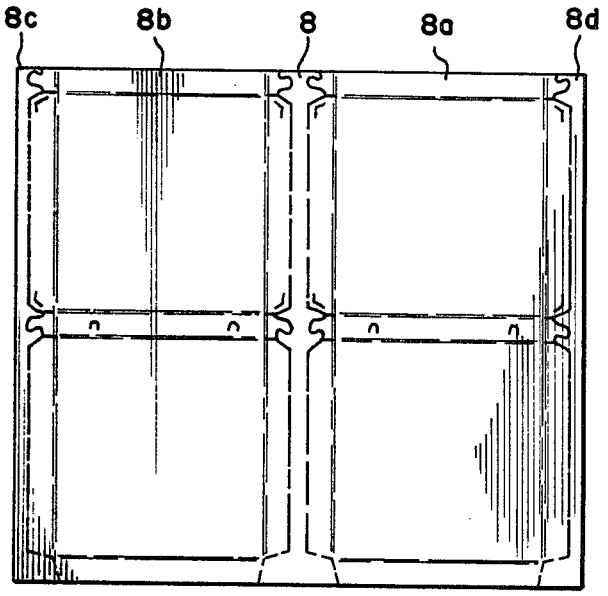
FIG. 4 illustrates the appearance of cardboard sheeting in a typical appearance thereof in elevation plan view in a precut and scored state, having strips precut and scored down the middle and along each of opposite edges thereof, ready for prior art stripping manually, but being the beginning product to be processed by this invention's machine.
Figure 5:
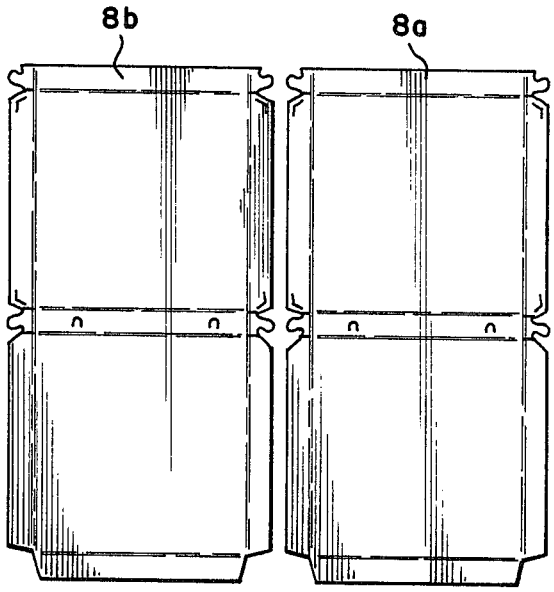
FIG. 5 illustrates an elevation plan view comparable to that of FIG. 4, except representing the appearance of the now two sections resulting from the stripping away of the waste strips of the precut sheeting of the FIG. 4 embodiment, as would be the appearance after automatic stripping by the machine of this invention such as illustrated in FIG. 1.

As illustrated in each of FIGS. 1 through 5, the sheeting 8 with its major sections 8a and 8b, is conveyed in direction 38 such that the forward traveling edges of the sheeting minor sections 8c, 8d, and 8e become physically engaged with leading edges of the stationarily mounted projection structures 17a, 17b, and 17c respectively, as for example leading of distal end 30a of projection structure 17b to channel or direct in direction 35 the stripped minor section 36 between pincher rolls 10 and 18 to travel in direction 37, while the stripped major section 8a, for example — both sections 8a and 8b being shown in FIGS. 1 and 5, continues to be supported and transported on the upper surface of the spaced-apart belts 9a, 9b, 9c, and 9d moving axially along their respective lengths in a common direction 38.

The FIG. 4 illustrates the sheeting of FIG. 1 before the stripping thereof, and FIG. 5 illustrates the sheeting of FIG. 1 after the stripping, better illustrating the respective major sections and minor sections, above discussed.

It is within the spirit and scope of the present invention to make such modifications and variations as would be recognized substitution of equivalents and/or variations within ordinary skill of this art. It should be noted that because of the resilient material 32, the pincher roll 18 is driven by pincher roll 10 by being in engagement with one-another, but that the stripped material 36 never the less becomes engaged therebetween by a yielding of the resilient rubber 32, for example.

I claim:

1. A stripping device comprising in combination: conveyor means for transporting a sheet structure along a first plane in a predetermined direction, where said sheet structure has a major section connected intermittently to a minor section of lesser surface area extending along said major section in a direction substantially parallel to said first direction; a projection structure having sides thereof extending in a substantially upright plane substantially parallel to said first direction and positioned at a predetermined laterally located position relative to said conveyor means adapted such that when said conveyor means transports said sheet structure in said first direction, said projection structure is positioned such that a forward face thereof intercepts a leading edge of said minor section to result in a stripping of the minor section from the major section and adapted such that the major section is thereafter conveyed continually by conveyor means to a predetermined point beyond said projection structure, and pincher surfaces in opposing relationship to oneanother positioned above and below said first plane and adapted such that during transport of said sheet structure, said pincher surfaces anchor said major section of the sheet structure during movement of said minor section against said projection structure, said projection structure being laterally adjacent said pincher surfaces and adapted such that stripping away of the minor section from the major section is facilitated thereby, said pincher surfaces comprising opposing roller surfaces mounted such that adjacent surfaces move in a common direction.

2. A stripping device comprising in combination: conveyor means for transporting a sheet structure along a first plane in a predetermined direction, where said sheet structure has a major section connected intermittently to a minor section of lesser surface area extending along said major section in a direction substantially parallel to said first direction; a projection structure with a forward face angled through said plane at a predetermined angle substantially less than 90° to the plane and having sides thereof extending in a substantially upright plane substantially parallel to said first direction and positioned at a predetermined laterally located position relative to said conveyor means adapted such that when said conveyor means adapted such that when said conveyor means transports said sheet structure in said first direction, said projection structure is positioned such that the forward face intercepts a leading edge of said minor section to result in a stripping of the minor section from the major section and adapted such that the major section is thereafter conveyed continually by said conveyor means to a predetermined point beyond said projection structure; and pincher surfaces in opposing relationship to one-another positioned above and below said first plane and adapted such that during transport of said sheet structure, said pincher surfaces anchor said major section of the sheet structure during movement of said minor section against said projection structure, said projection structure being laterally adjacent said pincher surfaces and adapted such that stripping away of the minor section from the major section is facilitated thereby; a forward face of said projection structure is shaped to direct stripped material in a second predetermined direction.

3. A stripping device of claim 2, including a further roller surface positioned in opposing pincher relationship to one of said pincher surfaces at a location for pinch-engaging said minor section after the minor section point of intersection with the projection structure whereby stripped material of the minor section is guidable by said leading surface to a position between the further roller surface and the pincher surface in opposition thereto to result in a pulling force on the stripped minor section, and including a drive means for rotating said further roller surface and at least one of said pincher surfaces.

4. A stripping device of claim 3, in which said conveyor means includes a plurality of spaced-apart belts extending and movable in said first direction.

* * * * *